United States Patent [19]

Onodera et al.

[11] 4,422,924

[45] Dec. 27, 1983

[54] SOLVENT DEWAXING WAXY HYDROCARBONS USING AN ALPHA OLEFIN POLYMER-OLEFIN VINYL ACETATE COPOLYMER COMPOSITE DEWAXING AID

[75] Inventors: Takashi Onodera, Urawa; Kikuji Komine, Tokorozawa; Fumis Ohashi; Tsutomu Naito, both of Oni, all of Japan

[73] Assignee: Toa Nenryo Kogyo Kabushiki Kaisha, Tokyo, Japan

[21] Appl. No.: 410,879

[22] Filed: Aug. 23, 1982

Related U.S. Application Data

[60] Division of Ser. No. 305,919, Sep. 28, 1981, which is a continuation-in-part of Ser. No. 233,380, Feb. 11, 1981, abandoned, which is a continuation-in-part of Ser. No. 184,921, Sep. 8, 1980, abandoned, which is a continuation of Ser. No. 102,652, Dec. 12, 1979, abandoned, which is a continuation of Ser. No. 36,044, May 4, 1979, abandoned, which is a division of Ser. No. 926,811, Jul. 21, 1978, Pat. No. 4,192,733.

[51] Int. Cl.[3] ..... C10G 73/04; C10G 73/06

[52] U.S. Cl. ..... 208/33

[58] Field of Search ..... 208/33

[56] References Cited

U.S. PATENT DOCUMENTS

| | | | |
|---|---|---|---|
| 2,798,027 | 7/1957 | Cohen | 196/19 |
| 3,239,445 | 3/1966 | Leonard et al. | 208/33 |
| 3,355,379 | 11/1967 | Leonard | 208/33 |
| 3,458,430 | .7/1969 | Henselman et al. | 208/33 |
| 3,475,321 | 10/1969 | Henselman et al. | 208/33 |
| 3,767,561 | 10/1973 | Rossi et al. | 208/37 |
| 3,806,442 | 4/1974 | Reid et al. | 208/33 |
| 3,860,543 | 1/1975 | Masuda et al. | 260/28.5 |
| 3,981,850 | 9/1976 | Wisotsky et al. | 526/227 |
| 4,126,649 | 11/1978 | Decroix | 260/897 B |

FOREIGN PATENT DOCUMENTS

| | | |
|---|---|---|
| 41-1537970 | 8/1966 | Japan . |
| 45-2692274 | 12/1970 | Japan . |
| 1303126 | 1/1973 | United Kingdom . |

*Primary Examiner*—Curtis R. Davis
*Assistant Examiner*—Glenn A. Caldarola
*Attorney, Agent, or Firm*—Joseph J. Allocca

[57] ABSTRACT

An improved dewaxing aid for solvent dewaxing process comprising a mixture of (A) an $\alpha$-olefin polymer having an average molecular weight of from about 10,000 to 1,000,000 and a wide molecular weight distribution exceeding the range of from about 10,000 to 1,000,000 but falling within the range of from about 2,000 to 3,000,000 wherein the $\alpha$-olefin polymer is a homopolymer made up of a $C_{10}$ to $C_{25}$ alpha-olefin monomer or is a copolymer made up of a monomer mixture comprising more than 50 wt. % of at least 2 $C_{10}$ to $C_{25}$ alpha-olefin monomers and a melt index greater than 1.8 g/10 min. and (B) an olefin vinyl acetate copolymer having a vinyl acetate content of from about 15 to 40 wt. % and an average molecular weight of from about 50,000 to 1,000,000 and a melt index greater than 2 g/10 min. The $\alpha$-olefin polymer having a high molecular weight and wide molecular weight distribution, when combined with the olefin-vinyl acetate copolymer, synergistically improves the efficiency of wax separation.

14 Claims, No Drawings

SOLVENT DEWAXING WAXY HYDROCARBONS USING AN ALPHA OLEFIN POLYMER-OLEFIN VINYL ACETATE COPOLYMER COMPOSITE DEWAXING AID

This is a division, of application Ser. No. 305,919, filed 9/28/81 which is a continuation-in-part of 233,380, filed 2/11/81, abandoned which is a continuation-in-part of 184,921, filed 9/8/80, abandoned which is a R. 60 Cont. of 102,652, filed 12/12/79, abandoned which is a R 60 Cont. of 36,044, filed 5/4/79, abandoned, which is a R. 60 Div. of 926,811 filed 7/26/78 now U.S. Pat. No. 4,192,733.

BACKGROUND OF THE INVENTION

1. Field of the Invention

The present invention relates to the use of a dewaxing aid in a process for the solvent dewaxing of a wax-containing hydrocarbon oil. More particularly, this invention relates to a solvent dewaxing process containing a dewaxing aid comprising a mixture of (A) an α-olefin copolymer and (B) an olefin-vinyl acetate copolymer. Still more particularly, this invention relates to an improvement in a solvent dewaxing process using a dewaxing aid wherein the improvement comprises a dewaxing aid comprising a mixture of (A) an α-olefin polymer having a molecular weight ranging from about 10,000 to 1,000,000 and a wide molecular weight distribution exceeding the range of from about 10,000 to 1,000,000 but falling within the range of from about 2,000 to 3,000,000 and a melt index greater than 1.8 g/10 min., where the α-olefin polymer is a homopolymer made up of a $C_{10}$ to $C_{25}$ alpha olefin monomer or is a copolymer made up of a monomer mixture comprising more than 50 wt. % of at least two $C_{10}$ to $C_{25}$ alpha-olefin monomers and (B) an olefin-vinyl acetate copolymer having a vinyl acetate content ranging from about 15–40 wt. % and having an average molecular weight of from about 50,000 to 1,000,000 and a melt index greater than 2 g/10 minutes.

2. Description of the Prior Art

Waxes in wax-containing hydrocarbon oils are removed therefrom by chilling the oil to precipitate out the wax and then separating the solid wax particles from the dewaxed oil by filtration or centrifugation. Industrial dewaxing processes include press dewaxing processes wherein the wax-containing oil, in the absence of solvent, is chilled to crystallize out the wax particles which are then pressed out by a filter. In general, only light hydrocarbon oil fractions (paraffinic fractions) obtained by vacuum distillation are treated by the press dewaxing process due to viscosity limitations. More widely used are solvent dewaxing processes wherein a waxy oil is mixed with a solvent and then chilled to precipitate the wax as tiny particles or crystals thereby forming a slurry of solid wax particles and a dewaxed oil containing dewaxing solvent. The slurry is then fed to a wax filter wherein the wax is removed from the dewaxed oil and dewaxing solvent. Solvent dewaxing processes are used for heavier oil fractions such as lubricating oil fractions and bright stocks. Typical dewaxing solvents include low boiling point of autorefrigerative hydrocarbons such as propane, propylene, butane, pentane, etc., ketones such as mixtures of acetone and MEK or MEK and NIBK as well as mixtures of ketones and aromatic hydrocarbons such as MEK/toluene and acetone/benzene.

One of the factors tending to limit the capacity of a solvent dewaxing plant is the rate of wax filtration from the dewaxed oil, which in turn is strongly influenced by the crystal structure of the precipitated wax. Although the crystal structure of the precipitated wax is influenced by various operation conditions in the dewaxing process, for any given feed it is most strongly influenced by the chilling conditions. The size and crystal structure of the precipitated wax, occlusion of oil in the wax crystal and the condition of the oil left in the crystal are extremely varied and depend on the wax composition and precipitation conditions. These conditions also affect the filtration rate of the dewaxed oil from the wax and the yield of dewaxed oil. In some cases, most notably when the waxy oil is a bright stock, the wax crystals are of an extremely fine size and not all are separated by filtration, but some leave the filter with the dewaxed oil component which creates an objectionable haze in the oil. Also, in some dewaxing processes too-rapid chilling of the waxy oil results in a so-called shock chilling effect yielding extremely fine sizes of wax crystals having poor filtration characteristics exhibited as a reduction of the filtration rate, decreased yield and increased pour point of the dewaxed oil. This phenomena often happens in autorefrigerant dewaxing processes wherein the waxy oil is chilled by the latent heat of vaporization of an autorefrigerant such as liquid propane.

One way of increasing the wax filtration rate is to add a dewaxing aid to the wax-containing oil. Well known in the art are dewaxing aids such as α-olefin copolymers and mixtures of materials such as a mixture of an ethylene-vinyl acetate copolymer and an unsaturated ester of an aliphatic alcohol having from 2 to 20 carbon atoms with acrylic or methacrylic acid. However, these dewaxing aids are not terribly efficient, necessitating therefore relative high concentrations of same in the oil. This is especially true when a residual oil raffinate such as a bright stock is solvent dewaxed wherein a portion of the wax is precipitated as crystals so fine that they pass through filter cloths thereby creating a haze in the dewaxed oil which greatly reduces the commercial value of same. Haze may also appear when the dewaxed oil is allowed to stand at room temperature for a long time. In order to prevent the occurrence of haze, it is sometimes necessary to filter the dewaxed oil through a sintered metal filter or a polyvinyl alcohol filter after the dewaxing step, thereby adding to the complexity and cost of the dewaxing process. It has now been found that in order for a dewaxing aid in a liquid mixture of dewaxing solvent and wax-containing oil to avoid platelike, needle or amorphous crystals having relatively poor filtration characteristics and instead to form eutectic crystals with the wax that is precipitated via gradual cooling, which crystals are relatively uniform, spherical wax crystals having a size of from about 20 to about 100 microns which possess superior filtration characteristics resulting in faster wax filtration rates, it is necessary for the dewaxing aid to have a high average molecular weight and a wide molecular weight distribution.

SUMMARY OF THE INVENTION

Accordingly, therefore, it has now been found that an improvement results in processes for solvent dewaxing wax-containing hydrocarbon oils employing a dewaxing aid, if the dewaxing aid comprises a mixture of (A) an α-olefin polymer having an average molecular weight of from about 10,000 to 1,000,000 and a melt index greater than 1.8 g/10 min. wherein the α-olefin polymer is a homopolymer made up of a $C_{10}$ to $C_{25}$ alpha-olefin monomer or is a copolymer made up of a monomer mixture comprising more than 50 wt. % of at least 2 $C_{10}$ to $C_{25}$ alpha-olefin monomers, and (B) an olefin-vinyl acetate copolymer having a vinyl acetate content from about 15 to 40 wt. % and an average molecular weight of from about 50,000 to 1,000,000 and a melt index greater than 2 g/10 min. This dewaxing aid will be added to the wax-containing hydrocarbon oil in an amount ranging from about 0.1 to 1 wt. % of the oil and at an α-olefin polymer to olefin-vinyl acetate copolymer weight ratio ranging from about 95/5 to 5/95. The α-olefin polymer having a relatively high molecular weight and wide molecular weight distribution, when combined with the olefin-vinyl acetate copolymer, synergistically improves the efficiency of wax separation. This results in increased filtration rates and higher yields of dewaxed oil without haze in said dewaxed oil.

The α-olefin polymer component of the dewaxing aid of this invention may be either a homopolymer of an α-olefin having from 10 to 25 carbon atoms in the molecule, or a copolymer of at least 50 wt. % of two such $C_{10}$ to $C_{25}$ α-olefin monomers. An illustrative but nonlimiting example of a preferred α-olefin copolymer would include a polymer obtained by polymerizing an α-olefin mixture comprising 0 to 50 wt. % of an α-olefin having 10 carbon atoms, 20 to 40 wt. % of an α-olefin having 16 carbon atoms and 0 to 30 wt. % of an α-olefin having 22 carbon atoms. A minor amount of an olefin other than an alpha-olefin, such as a diolefin, may be included in the alpha-olefins to be polymerized.

Although the average molecular weight of the alpha-olefin polymer of this invention can range from about 100,000 to 1,000,000, it is preferred that the average molecular weight fall within the range of from about 200,000 to 800,000. It is also preferred that the molecular weight distribution exceed the range of from about 10,000 to 1,000,000 and it is especially preferred that it fall within the range of from about 2,000 to 3,000,000. Thus it is seen that the molecular weight distribution of the alpha-olefin polymers useful in the instant invention are relatively wide, which is in contrast to the relatively narrow distribution (about 2,000 to 200,000) existing for some known alpha-olefin polymers which did not yield the desired dewaxing performance.

The following method has been found useful for preparing the alpha-olefin homopolymers or copolymers useful in the present invention.

Under anhydrous conditions, a eutectic titanium trichloride/aluminum trichloride catalyst ($TiCl_3/\frac{1}{3}.AlCl_3$) is activated by an organoaluminum compound such as triethyl aluminum or diethyl aluminum chloride in the presence of a solvent, for example, a hydrocarbon such as xylene. An α-olefin having a predetermined composition is added and polymerization is carried out at a temperature ranging from about room temperature to 90° C. under atmospheric or superatmospheric pressure. It is preferred that the solvent and catalyst be used in amounts ranging from about 100 to 200,000 parts by weight and from about 0.01 to 5 parts by weight, respectively, per 100 parts by weight of the resulting polymer. In order to obtain a polymer having the desired high average molecular weight, it is necessary to conduct the polymerization at a relatively low temperature ranging from room temperature to about 50° C. for a relatively long time, for example, at least 6 hours.

By adopting the foregoing polymerization conditions, it is possible to broaden the molecular weight distribution range remarkably over the molecular weight distribution range in the known polymers. Further, such broad molecular weight distribution range can be attained according to a method in which polymers differing in the molecular weight distribution range are mixed together in appropriate proportions.

The olefin-vinyl acetate copolymer that is used as component (B) of the present invention is a copolymer having a vinyl acetate content ranging from about 15 to 40 wt. % and the inherent viscosity of the copolymer is preferably 0.5 to 1.5 poises (as measured at 30° C. with respect to a toluene solution containing 0.25 wt. % of the polymer). An α-olefin, especially ethylene, is preferred as the olefin component. The average molecular weight of the copolymer will range from about 50,000 to 1,000,000, preferably from about 100,000 to 800,000, and the molecular weight distribution should exceed the range of from 10,000 to 1,000,000 but be within the range of from about 2,000 to 1,500,000. The olefin vinyl acetate copolymer has a melt index greater than 2 g/10 minutes.

The copolymer is prepared by charging an olefin and vinyl acetate in a reaction vessel and polymerizing them batchwise or continuously in the presence of an organic peroxide catalyst such as tertiary-butyl hydroperoxide under a pressure of from 300 to 3000 atmospheres, preferably 1000 to 3000 atmospheres, at a temperature of from 100° to 250° C. Commercially available products such as Elvax (manufactured by DuPont), Evaflex (manufactured by Mitsui Polychemical) and Ultracene (manufactured by Nippon Polychemical) may be used as component (B).

When only component (A) of the dewaxing aid of present invention is used, some improvement in dewaxing performance may in some instances be attained. However, when component (A) is combined with the olefin-vinyl acetate copolymer component (B), prominent synergistic effects can be attained. When component (B) alone is used, the bulkiness of the wax crystals can be reduced, but the faces of the wax crystals adhere to one another thereby rendering passage of the oil component difficult, with the result that the filtration rate is reduced and unsatisfactory dewaxing performance is attained.

Components (A) and (B) constituting the dewaxing aid of this invention will be used in a weight ratio to each other ranging from 95/5 to 5/95 and preferably from 50/50 to 80/20 of (A)/(B). This dewaxing aid is added to the waxy oil feed in an amount ranging from about 0.01 to 1 wt. % and preferably from about 0.05 to 0.5 wt. % of the oil. It has been found that if the amount of dewaxing aid is less than about 0.01 wt. % no satisfactory performance can be obtained and, conversely, if the amount of dewaxing aid is increased to more than about 1 wt. %, the dewaxing rate is reduced and the process becomes disadvantageous from an economical viewpoint. When used in this invention it is advantageous to dissolve and disperse the dewaxing aid in a mineral oil or the like so that the concentration of dewaxing aid therein ranges from about 30 to 50 wt. %. It is preferred that the dewaxing aid be used in the form of a solution having a viscosity ranging from about 50 to 800 cs measured at 98.5° C.

Any waxy petroleum oil stock or distillate fraction thereof may be dewaxed employing the dewaxing aid of this invention. Illustrative but nonlimiting examples of such stocks are (a) distillate fractions that have a boiling range within the broad range of from about 500° to 1300° F., with preferred stocks including lubricating oil and specialty oil fractions boiling within the range of from between about 550° to 1200° F. and (b) bright stocks and deasphalted resids having an initial boiling point above about 800° F. Additionally, any of these feeds may be hydrocracked prior to distilling, or deasphalting. These may come from any source such as paraffinic crudes obtained from Aramco, Kuwait, panhandle, North Louisiana, etc., naphthenic crudes, such as Tia Juana, coastal crudes, etc., as well as the relatively heavy feedstocks such as brightstocks having a boiling range of 1050+° F. and synthetic feedstocks derived from Athabasca tar sands or coal, etc. This invention has been found to be particularly suited for dewaxing heavier feedstocks such as brightstocks and deasphalted resids.

The dewaxing solvent that is used in the present invention is not particularly critical. Namely, any of solvents having a selective dissolving property to the oil component of a wax-containing oil at a dewaxing low temperature can be used. For example, there may be used at least one member selected from linear hydrocarbons having 2 to 10 carbon atoms in the molecule, such as ethane, propane, butane, pentane, hexane, octane, ethylene, propylene, butylene, pentene, hexene and octene, or a mixture of at least one member selected from ketones, such as acetone, dimethyl ketone, methylethyl ketone, methylpropyl ketone and methylisobutyl ketone with at least one member selected from aromatic hydrocarbons such as benzene and toluene, e.g., methylethyl ketone/toluene or methylisobutyl ketone/toluene. Further, N-alkylpyrrolidones such as N-methylpyrrolidone and N-ethylpyrrolidone may be used as the dewaxing solvent. Still further, an autorefrigerative mixed solvent such as a mixture of a linear hydrocarbon such as mentioned above with a ketone such as acetone can be used as the dewaxing solvent. Solvents preferred for practicing the process of the present invention include propane, other autorefrigerative solvents and a mixture of a ketone and an aromatic hydrocarbon.

The molecular weight of the polymers used in the dewaxing aid of this invention was determined according to the following methods:

In case of component (A), molecular weight of up to about 50,000 was determined according to the gas phase permeation pressure method (Hitachi Model 117 is used; this method is detailed in "MEASUREMENT METHODS FOR POLYMERS, STRUCTURES AND PROPERTIES, Volume 1" compiled by Japanese Association of Polymers and published by Baifukan in 1973, pages 57 to 75) and when the molecular weight was larger than about 50,000, the molecular weight was determined according to the membrane permeation pressure method (Yokokawa-Hulette Package Model 502 is used; this method is detailed on pages 48 to 56 of the above-mentioned literature reference). According to these methods, the number average molecular weight can be determined. The weight average molecular weight is determined according to the GPC method described below.

The weight average molecular weight of component (B) composed of an olefin-vinyl acetate copolymer was determined according to the light scattering method (Shimazu PG-21 is used; the method is described on pages 33 to 47 of the above-mentioned literature reference).

The molecular weight distribution was determined by measuring differential diffractions according to the gel permeation chromatography (GPC) method (Nippon Bunseki Kogyo Model LC-8 is used, the method is described on pages 76 to 89 of the above-mentioned literature reference).

PREFERRED EMBODIMENT

In a preferred embodiment of the process of this invention, a solution of dewaxing aid comprising components (A) and (B) in an appropriate petroleum fraction is mixed into a wax-containing oil, and the mixture heated at a temperature higher than the cloud point of the oil (about 50° to 120° C.) and introduced, along with dewaxing solvent, into a chilling zone and the mixture chilled to a temperature necessary to yield the desired pour point for the resulting dewaxed oil. The chilling produces a slurry comprising dewaxed oil and solvent along with solid particles of wax which contain the dewaxing aid. This slurry is then sent to a wax filter to separate the dewaxed oil and solvent from the wax particles. The dewaxing temperature varies depending on the feed and conditions, but in general, the dewaxing temperature will range from about 0° to −50° C. In the case where a dewaxing solvent comprises a mixture of ketone/aromatic hydrocarbon, such as methyl ethyl ketone/toluene, the dewaxing temperature will range from about −10° to about −30PC. Where propane is used as a dewaxing solvent, the dewaxing temperature will generally be from about −20° to −40° C. Preferred dewaxing solvents used in the process of the instant invention include propane, other autorefrigerative solvents and a mixture of a ketone and an aromatic hydrocarbon. The ratio of solvent to waxy oil will generally range from about 0.5 to 10 and preferably from about 2 to 7, by volume. The optimum amount of dewaxing solvent employed is, of course, determined by the wax content of the oil, viscosity, pretreatment and dewaxing conditions. It is also important to note that the dewaxing aid of this invention can be separated and recovered from the slack wax produced by the dewaxing operation via vacuum distillation under conditions disclosed in U.S. Pat. No. 4,192,732 and the recovered dewaxing aid cycled repeatedly back into the dewaxing operation.

The invention will be more apparent from working Examples set forth below.

EXAMPLES

EXAMPLES 1 AND 2

A raffinate obtained by extracting a medium lubricating oil fraction from a vacuum distillation column with phenol [having a wax content of 15.7 wt. %, a specific gravity of 0.8830, 15/4° C., a viscosity of 7.869 cst (as measured at 98.9° C.) and a viscosity index of 106.9] was charged in an autoclave along with dewaxing aid $A_2/B$ or $A_3/B$ shown in Table 1 and propane as a solvent in an amount 4 times the amount of the wax-containing oil by volume. The mixture was heated at 70° C. to form a homogeneous solution of the contents, and the solution was externally chilled to 10° C. under agistation at a chilling rate of 2° C./minute. Then the propane solvent was evaporated and the mixture was chilled to −40° C. at a chilling rate of 2° C./minute by latent heat of evaporation of the propane. After the chilling operation, the solvent-dewaxed oil/wax slurry was fed to a wax filter where filtration was conducted for 40 seconds at a filtration pressure differential of 550 mmHg, and the filtration rate was determined. The obtained results are shown in Table 1.

Comparative Examples 1 to 5

The same raffinate extracted from a medium oil fraction was subjected to the propane dewaxing in the same manner as in Examples 1 and 2 by using, as dewaxing aid, $A_1$, $A_3$, B or $A_1B$ shown in Table 1. The propane dewaxing was also carried out without using any dewaxing aid. Obtained results are shown in Table 1.

TABLE 1

Composition of Dewaxing Aid

Component A: α-olefin copolymer $A_1$: comparative polymer (polymerization temperature = 100° C.), average molecular weight = 9,000, molecular weight distribution of 1,800 to 200,000

$A_2$: polymer of present invention (polymerization temperature = 50° C.), average molecular weight = 15,000, molecular weight distribution of 2,000 to 1,000,000

$A_3$: polymer of present invention (polymerization temperature = 30° C.), average molecular weight = 350,000, molecular weight distribution of 10,000 to 1,500,000, melt index 300 g/10 min.

Starting olefin composition 38 wt. % of $C_{10}$, 26 wt. % of $C_{16}$, 21 wt. % of $C_{18}$ and 15 wt. % of $C_{20}$ (The molecular weight was determined according to the membrane osmometric method in case of a polymer having a molecular weight higher than 50,000 and according to the gas phase osmometric method in case of a polymer having a molecular weight lower than Component B: ethylene-vinyl acetate copolymer, $B_1$: Vinyl acetate content = 33 wt. %, average molecular weight = 230,000, molecular weight distribution of 4,000 to 1,000,000, melt index 25 g/10 min.

(The molecular weight was determined according to the light scattering method.)

Dewaxing Results

| | Comparative Example No. | | | | |
|---|---|---|---|---|---|
| | 1 | 2 | 3 | 4 | 5 |
| Kind of dewaxing aid | not added | $A_1$ | $A_3$ | $B_1$ | $A_1/B_1$ |
| Mixing ratio (%) in dewaxing aid | — | 100 | 100 | 100 | 65/35 |
| Amount of dewaxing aid (wt. % based on oil feed) | — | 0.1 | 0.1 | 0.1 | 0.1 |
| Filtration rate (gal/ft$^2$/hr) | 1.6 | 4.9 | 10.3 | 4.1 | 8.3 |
| Relative filtration rate | 14 | 44 | 95 | 37 | 75 |
| Yield (wt. %) of dewaxed oil | 65 | 75 | 79 | 74 | 78 |
| Oil content (wt. %) in slack wax | 56 | 40 | 25 | 42 | 32 |

| | Example No. | |
|---|---|---|
| | 1 | 2 |
| Kind of dewaxing aid | $A_2/B_1$ | $A_3/B_1$ |
| Mixing ratio (%) in a dewaxing aid | 65/35 | 65/35 |
| Amount of dewaxing aid (wt. % based on oil feed) | 0.1 | 0.1 |
| Filtration rate (gal/ft$^2$/hr) | 11.1 | 28.3 |
| Relative filtration rate | 100 | 254 |
| Yield (wt. %) of dewaxed oil | 81 | 84 |
| Oil content (wt. %) in slack wax | 21 | 8 |

EXAMPLES 3 TO 4

The solvent dewaxing was carried out under the same conditions as in Examples 1 and 2 except that a residual oil raffinate (having a wax content of 20.8 wt. %, a specific gravity of 0.9006, 15/4° C., a viscosity of 28.5 cst as measured at 98.9° C. and a viscosity index of 103) was used as the oil feed and the dewaxing aid was changed to $A_4/B_1$ or $A_5/B_1$ shown in Table 2. Obtained results are shown in Table 2.

Comparative Examples 6 to 9

The oil feed described in Examples 3 to 4 (residual oil raffinate) was subjected to the propane dewaxing by using a dewaxing aid component $A_4$, $A_5$ or $B_1$ shown in Table 2 alone or without using any dewaxing aid. Obtained results are shown in Table 2.

TABLE 2

Composition of Dewaxing Aid

Component A: α-olefin copolymer $A_4$: comparative polymer (polymerization temperature = 100° C.), average molecular weight = 11,000, molecular weight distribution of 2,000 to 200,000

$A_5$: polymer of present invention (polymerization temperature = 20° C.), average molecular weight = 1,000,000, molecular weight distribution of 10,000 to 2,000,000, melt index 300 g/10 min.

Starting olefin composition 30 wt. % of $C_{16}$, 20 wt. % of $C_{18}$, 30 wt. % of $C_{20}$ and 20 wt. % of $C_{22}$ Component $B_1$: same ethylene-vinyl acetate copolymer as in Examples 1 and 2

Dewaxing Results

| | Comparative Example No. | | | | Example No. | |
|---|---|---|---|---|---|---|
| | 6 | 7 | 8 | 9 | 3 | 4 |
| Kind of dewaxing aid | not added | $A_4$ | $A_5$ | $B_1$ | $A_4/B_1$ | $A_5/B_1$ |
| Mixing ratio (%) in dewaxing aid | — | 100 | 100 | 100 | 65/35 | 65/35 |
| Amount of dewaxing aid (wt. % based on oil feed) | — | 0.1 | 0.1 | 0.1 | 0.1 | 0.1 |
| Filtration rate (gal/ft$^2$/hr) | 1.5 | 6.0 | 8.3 | 7.1 | 10.5 | 20.3 |
| Relative filtration rate | 14 | 57 | 82 | 68 | 100 | 193 |
| Yield (Wt. %) of dewaxed oil | 54 | 70 | 73 | 74 | 76 | 89 |
| Oil content (wt. %) in slack wax | 56 | 31 | 24 | 16 | 10 | 7 |
| Occurence of haze in dewaxed oil | seen | seen | not seen | not seen | not seen | not seen |

EXAMPLES 5 TO 6

The residual oil raffinate described in Examples 3 and 4 was dewaxed by using the same dewaxing aid ($A_4/B_1$ or $A_5/B_1$) and a mixed solvent of methylethyl ketone and toluene (50:50) instead of propane. Obtained results are shown in Table 3.

Comparative Examples 10 to 13

The oil feed described in Examples 3 and 4 (residual oil raffinate) was dewaxed with a mixed solvent of methylethyl ketone and toluene (50:50)by using the dewaxing aid component $A_4$, $A_5$ or $B_1$ shown in Table 2 alone or without using any dewaxing aid. Obtained results are shown in Table 3.

TABLE 3

| | Dewaxing Results | | | | | |
|---|---|---|---|---|---|---|
| | Comparative Example No. | | | | Example No. | |
| | 10 | 11 | 12 | 13 | 5 | 6 |
| Kind of dewaxing aid | not added | $A_4$ | $A_5$ | $B_1$ | $A_4/B_1$ | $A_5/B_1$ |
| Mixing ratio (%) in dewaxing aid | — | 100 | 100 | 100 | 65/35 | 65/35 |
| Amount of dewaxing aid (wt. % based on oil feed) | — | 0.1 | 0.1 | 0.1 | 0.1 | 0.1 |
| Filtration Rate (gal/ft$^2$/hr) | 1.1 | 4.3 | 6.2 | 7.1 | 10.5 | 20.3 |
| Relative filtration rate | 18 | 69 | 100 | 68 | 123 | 193 |
| Yield (wt. %) of dewaxed oil | 56 | 66 | 70 | 74 | 76 | 89 |
| Oil content (wt. %) in slack wax | 55 | 42 | 35 | 16 | 8 | 7 |
| Occurrence of haze in dewaxed oil | seen | seen | not seen | not seen | not seen | not seen |

Comparative Examples 14–22

The same raffinate extracted from a medium oil fraction was subjected to propane dewaxing in the same manner as in Examples 1 and 2 by using, as dewaxing aid $A_3$, $B_1$, $A_6/B_2$, $A_6/B_2$, $A_6/B_1$, $A_3/B_2$, $A_7/B_1$, $A_7$, $A_6$, $B_2$ as shown in Table 4.

Composition of Dewaxing Acid

Component A: α-olefin copolymers $A_6$: 1-butene homopolymer (comparative polymer) Average molecular weight 700,000, molecular weight distribution 50,000–2,000,000 density 0.913 g/cc, melt index 1.8 g/10 min.

$A_7$: Alpha-olefin copolymer average molecular weight 250,000, molecular weight distribution 10,000–1,500,000, melt index 200 g/10 min.

Starting olefin composition:

34 wt. % $C_4$, 22 wt. % $C_{15}$, 34 wt. % $C_{18}$, 20 wt. % $C_{20}$

Component B: ethylene-vinyl acetate copolymer $B_2$: vinyl acetate content 25 wt. %, average molecular wt. 350,000, molecular wt. distribution 10,000–1,200,000, melt index 2 g/10 min.

TABLE 4

| | DEWAXING TEXT RESULT | | | | | | | | | | | |
|---|---|---|---|---|---|---|---|---|---|---|---|---|
| | 1 | 3 | 4 | 14 | 15 | 16 | 17 | 18 | 19 | 20 | 21 | 22 |
| Kind of Aid | None | $A_3$ | $B_1$ | $B_2$ | $A_6$ | $A_7$ | $A_7/B_1$ | $A_7/B_2$ | $A_6/B_1$ | $A_6/B_2$ | $A_6/B_2$ | $A_3/B_2$ |
| Mixing rates (%) in dewaxing aid | — | 100 | 100 | 100 | 100 | 100 | 65/35 | 65/35 | 65/35 | 92/8 | 65/35 | 65/35 |
| Dosage (wt. %) | — | 0.1 | 0.1 | 0.1 | 0.1 | 0.1 | 0.1 | 0.1 | 0.1 | 0.1 | 0.1 | 0.1 |
| Melt Index (g/10 min) | — | 300 | 25 | 2 | 1.8 | 200 | — | — | — | — | — | — |
| Filtration rate (USG/ft$^2$/hr) | 1.6 | 10.3 | 4.1 | 1.2 | 0.5 | 6.2 | 25.2 | 3.9 | 1.2 | 0.5 | 0.9 | 4.8 |
| Relative Filtration rate | 100 | 643 | 256 | 75 | 31 | 288 | 1575 | 244 | 75 | 31 | 56 | 300 |

What is claimed is:

1. In a solvent dewaxing process wherein a waxy hydrocarbon oil is mixed with a dewaxing aid and dewaxing solvent and chilled to form a slurry comprising solid particles of wax and a mixture of dewaxed oil and solvent, the improvement which comprises using as a dewaxing aid a mixture of (A) an alpha-olefin homopolymer prepared from at least one alpha-olefin having from 10 to 25 carbon atoms or a copolymer made up of a monomer mixture comprising more than 50 wt. % of at least 2 $C_{10}$ to $C_{25}$ alpha-olefin monomers, said alpha-olefin polymer having an average molecular weight of from between about 10,000 to 1,000,000, and having a melt index greater than 1.8 g/10 minutes and (B) an olefin-vinyl acetate copolymer having a vinyl acetate molecular weight of from about 50,000 to 1,000,000, and a melt index greater than 2 g/10 minutes and wherein components (A) and (B) are used in a weight ratio to each other ranging from about 95/5 to 5/95 of (A)/(B).

2. The process of claim 1 wherein said alpha-olefin polymer has a molecular weight distribution exceeding the range of from about 10,000 to 1,000,000.

3. The process of claim 2 wherein said alpha-olefin polymer has a molecular weight distribution within the range of from about 2,000 to 3,000,000.

4. The process of claim 3 wherein said alpha-olefin polymer has an average molecular weight within the range of from about 200,000 to 800,000.

5. The process of claim 4 wherein said olefin-vinyl acetate copolymer has an average molecular weight of from between about 100,000 to 800,000.

6. The process of claim 5 wherein said dewaxing aid is used in an amount ranging from about 0.01 to 1 wt. % of said waxy oil.

7. The process of claim 6 wherein said components (A) and (B) are used in a weight ratio to each other of from about 50/50 to 80/20 of (A)/(B).

8. The process of claim 7 wherein said olefin-vinyl acetate copolymer has a molecular weight distribution exceeding the range of from about 10,000 to 1,000,000 but within the range of from about 2,000 to 1,500,000.

9. The process of claim 8 wherein said dewaxing aid is used in an amount ranging from about 0.05 wt. % of said waxy oil.

10. The process of claim 9 wherein said olefin-vinyl acetate copolymer is an ethylene vinyl acetate copolymer.

11. In a solvent dewaxing process wherein a waxy petroleum oil stock is mixed with a dewaxing aid in an amount of from 0.1 to 1 wt. % of said waxy feed and dewaxing solvent and chilled to form a slurry comprising solid particles of wax and a mixture of dewaxed oil and solvent, the improvement which comprises using as a dewaxing aid a mixture of (A) an alpha-olefin homopolymer prepared from at least one alpha-olefin having from 10 to 25 carbon atoms or a copolymer made up of a monomer mixture comprising more than 50 wt. % of at least 2 $C_{10}$ to $C_{25}$ alpha-olefin monomers, said alpha olefin polymer having an average molecular weight of from between about 10,000 to 1,000,000, a molecular weight distribution exceeding the range of from about 10,000 to 1,000,000 but within the range of from about 2,000 to 3,000,000 and having a melt index greater than 1.8 g/10 minutes and (B) an olefin-vinyl acetate copolymer having a vinyl acetate content of from about 15–40 wt. %, an average molecular weight of from about 50,000 to 1,000,000, a molecular weight distribution exceeding the range of from about 10,000 to 1,000,000 but within the range of from about 2,000 to 1,500,000 and a melt index greater than 2 g/10 minutes and wherein components (A) and (B) are used in a weight ratio to each other ranging from about 95/5 to 5/95 of (A)/(B).

12. The process of claim 11 wherein the molecular weight of said alpha-olefin polymer is within the range of from about 100,000 to 800,000.

13. The process fo claim 12 wherein said olefin-vinyl acetate copolymer is an ethylene-vinyl acetate copolymer.

14. The process of claim 13 wherein said components (A) and (B) are used in a weight ratio to each other of from about 50/50 to 80/20 of (A)/(B).

* * * * *